US012669042B2

(12) United States Patent
Driller et al.

(10) Patent No.: US 12,669,042 B2
(45) Date of Patent: Jun. 30, 2026

(54) SYSTEM AND METHOD FOR PROVIDING MISCIBLE DISPLACEMENT IN A HYDRAULICALLY-STIMULATED RESERVOIR

(71) Applicant: INNOVEX DOWNHOLE SOLUTIONS, INC., Humble, TX (US)

(72) Inventors: Brent Driller, Houston, TX (US); Nick Tonti, Houston, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 0 days.

(21) Appl. No.: 19/074,919

(22) Filed: Mar. 10, 2025

(65) Prior Publication Data

US 2025/0290393 A1 Sep. 18, 2025

Related U.S. Application Data

(60) Provisional application No. 63/565,053, filed on Mar. 14, 2024.

(51) Int. Cl.
*E21B 43/14* (2006.01)
*E21B 33/12* (2006.01)
*E21B 43/08* (2006.01)

(52) U.S. Cl.
CPC ..... *E21B 43/14* (2013.01); *E21B 33/12* (2013.01); *E21B 43/084* (2013.01)

(58) Field of Classification Search
CPC ..... E21B 43/14; E21B 33/12; E21B 43/084; E21B 17/18
See application file for complete search history.

(56) References Cited

U.S. PATENT DOCUMENTS 6,318,469 B1 * 11/2001 Patel ..... E21B 43/12 166/305.1
2002/0088621 A1 * 7/2002 Hamilton ..... E21B 43/162 166/186
2006/0237197 A1 * 10/2006 Dale ..... E21B 43/14 166/236
2014/0262240 A1 * 9/2014 Boone ..... E21B 43/267 166/263
2017/0030173 A1 * 2/2017 MacPhail ..... E21B 43/12
2021/0222531 A1 * 7/2021 Greci ..... E21B 43/14

FOREIGN PATENT DOCUMENTS

CA 3022711 C * 12/2020 ..... E21B 43/25
WO WO-9904137 A1 * 1/1999 ..... E21B 43/121
WO WO-2013104770 A2 * 7/2013 ..... E21B 17/18

* cited by examiner

*Primary Examiner* — James G Sayre

(74) *Attorney, Agent, or Firm* — MH2 Technology Law Group, LLP

(57) ABSTRACT

A downhole tool for use in a wellbore includes a body having an end connected to a work string. The downhole tool also includes a first flowpath in the body. The first flowpath configured to allow a first fluid from a production zone in the wellbore to flow through the body. The downhole tool further includes a second flowpath configured to allow a second fluid to be injected into an injection zone in the wellbore simultaneously with the first fluid flowing through the first flowpath.

8 Claims, 10 Drawing Sheets

SYSTEM AND METHOD FOR PROVIDING MISCIBLE DISPLACEMENT IN A HYDRAULICALLY-STIMULATED RESERVOIR

CROSS-REFERENCE TO RELATED APPLICATIONS

This application claims priority to U.S. Provisional Patent Application No. 63/565,053, filed on Mar. 14, 2024, which is incorporated by reference.

BACKGROUND

A wellbore is drilled from the surface to a reservoir in a subterranean formation. The reservoir may include hydrocarbons (e.g., oil and/or gas). A first downhole tool may be used in the wellbore to inject a fluid (e.g., gas or water) into the reservoir to maintain or increase the pressure in the reservoir. A second downhole tool may be used to produce the hydrocarbons from the reservoir to the surface. What is needed is a downhole tool and method that are configured to provide simultaneous injection and production within the wellbore.

SUMMARY

A downhole tool for use in a wellbore is disclosed. The downhole tool includes a body having an end connected to a work string. The downhole tool also includes a first flowpath in the body. The first flowpath configured to allow a first fluid from a production zone in the wellbore to flow through the body. The downhole tool further includes a second flowpath configured to allow a second fluid to be injected into an injection zone in the wellbore simultaneously with the first fluid flowing through the first flowpath.

A method of using a downhole tool in a wellbore is also disclosed. The method includes running the downhole tool into the wellbore. The downhole tool has a first fluid flowpath and a second fluid flowpath. The method also includes producing a first fluid from a production zone in the wellbore via the first flowpath. The method also includes injecting a second fluid into an injection zone in the wellbore via the second flowpath simultaneously with producing the first fluid via the first flowpath.

A downhole tool for use in a wellbore is disclosed. The downhole tool includes a triple-connect device configured to be connected to a work string. The triple-connect device has a first flowpath and a second flowpath. The downhole tool also includes a production sub connected to the triple-connect device. The production sub having one or more radial slots in communication with the first flowpath to allow a first fluid to flow from a production zone in the wellbore. The downhole tool further includes an injection sub connected to the triple-connect device. The injection sub having one or more radial slots in communication with the second flowpath to allow a second fluid to be injected into an injection zone in the wellbore, wherein the second fluid flows through the second flowpath simultaneously with the first fluid flowing through the first flowpath.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
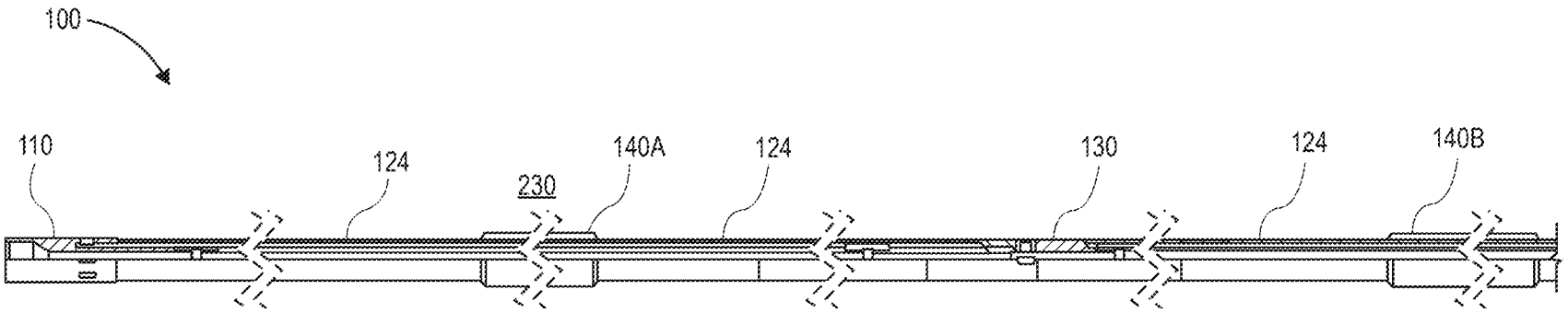
FIG. 1 illustrates a cross-sectional side view of a first portion of a dual string downhole tool showing a triple-connect device and a production sub, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

Dual String Downhole Tool

Figure 4:
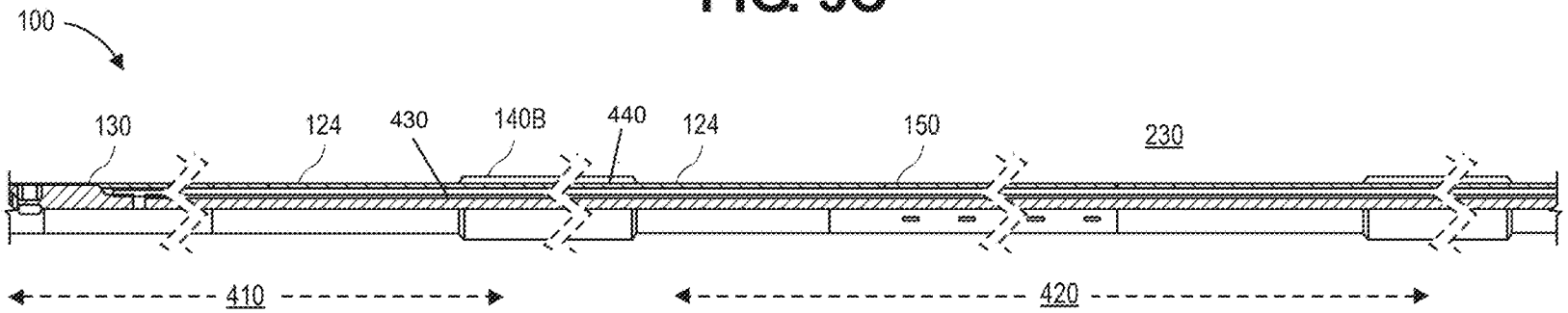
FIG. 4 illustrates a cross-sectional side view of a second portion of the dual string downhole tool showing an injection sub below the production sub, according to an embodiment.

FIG. 1 illustrates a cross-sectional side view of a first portion of a dual string downhole tool 100 showing a triple-connect device 110 and a production sub 130 (or a production section), according to an embodiment. FIG. 4 illustrates a cross-sectional side view of a second portion of the dual string downhole tool 100 showing an injection sub 150 (or an injection section) below the production sub 130, according to an embodiment. The dual string downhole tool 100 shown in FIGS. 1 and 4 may be configured to be run into a wellbore and to provide simultaneous injection and production therein.

The dual string downhole tool 100 may include a first flowpath that allows a first fluid (e.g., hydrocarbons) to flow from one or more production zones in the reservoir, into the dual string downhole tool 100, and up to the surface. The dual string downhole tool 100 may also include a second flowpath that simultaneously allows a second fluid (e.g., water or gas) to flow from the surface, through the dual string downhole tool 100, and into one or more injection zones in the reservoir.

Figure 2:
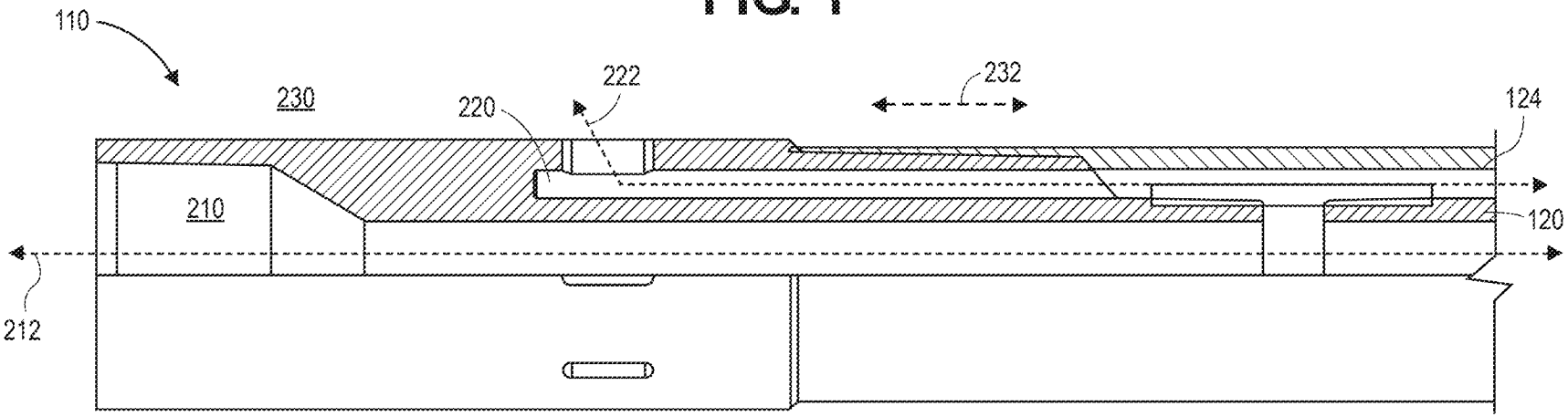
FIG. 2 illustrates an enlarged partial cross-sectional side view of the triple-connect device, according to an embodiment.

As shown in FIG. 1, the dual string downhole tool 100 may include the triple-connect device 110. The triple-connect device 110 may be coupled to a lower end of a tubular string in the wellbore (e.g., a drill string, a production string, a liner, a casing, etc.). FIG. 2 illustrates an enlarged partial cross-sectional side view of the triple-connect device 110, according to an embodiment. The triple-connect device 110 may include a first axial bore 210 that defines a first (e.g., inner) flowpath 212. The triple-connect device 110 may also include one or more second axial bores 220 that define one or more second (e.g., middle) flowpaths 222. A third (e.g., outer) flowpath 232 may be an annulus 230 between the dual string downhole tool 100 and a surrounding tubular (e.g., a liner, a casing, or the wall of the wellbore).

The first axial bore 210 may be positioned radially-inward from and/or circumferentially-offset from the second axial bores 220. The second axial bores 220 may be circumferentially-offset from one another around a central longitudinal axis of the dual string downhole tool 100. The triple-connect device 110 may be the entry point for the second axial bores 220. In one embodiment, the first axial bore 210 may be used for production (i.e., hydrocarbons flow uphole through the first flowpath 212 to the surface), and the second axial bores 220 may be used for injection (i.e., gas or water flow downhole through the second flowpaths 222 into the reservoir). However, in other embodiments, the flow directions may be reversed.

Referring again to FIG. 1, the dual string downhole tool 100 may also include one or more production subs (one is shown: 130). In other embodiments, the dual string downhole tool 100 may include a plurality of production subs 130 that are axially-offset from one another. The production sub 130 may be positioned below the triple-connect device 110.

Figure 3A:
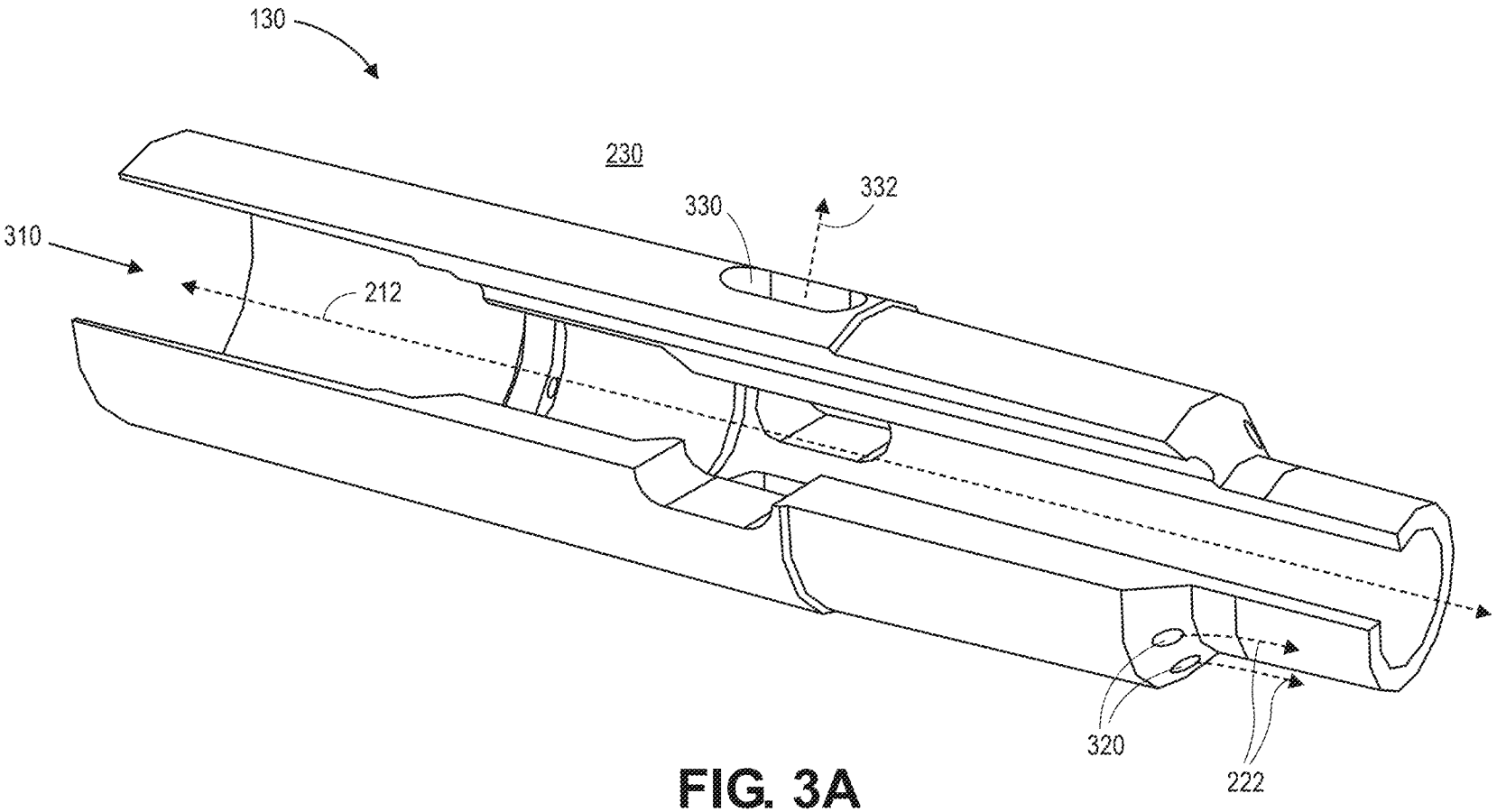
FIGS. 3A-3C illustrate a perspective view, a transparent side view, and a cross-sectional side view of the production sub, according to an embodiment.
Figure 3B:
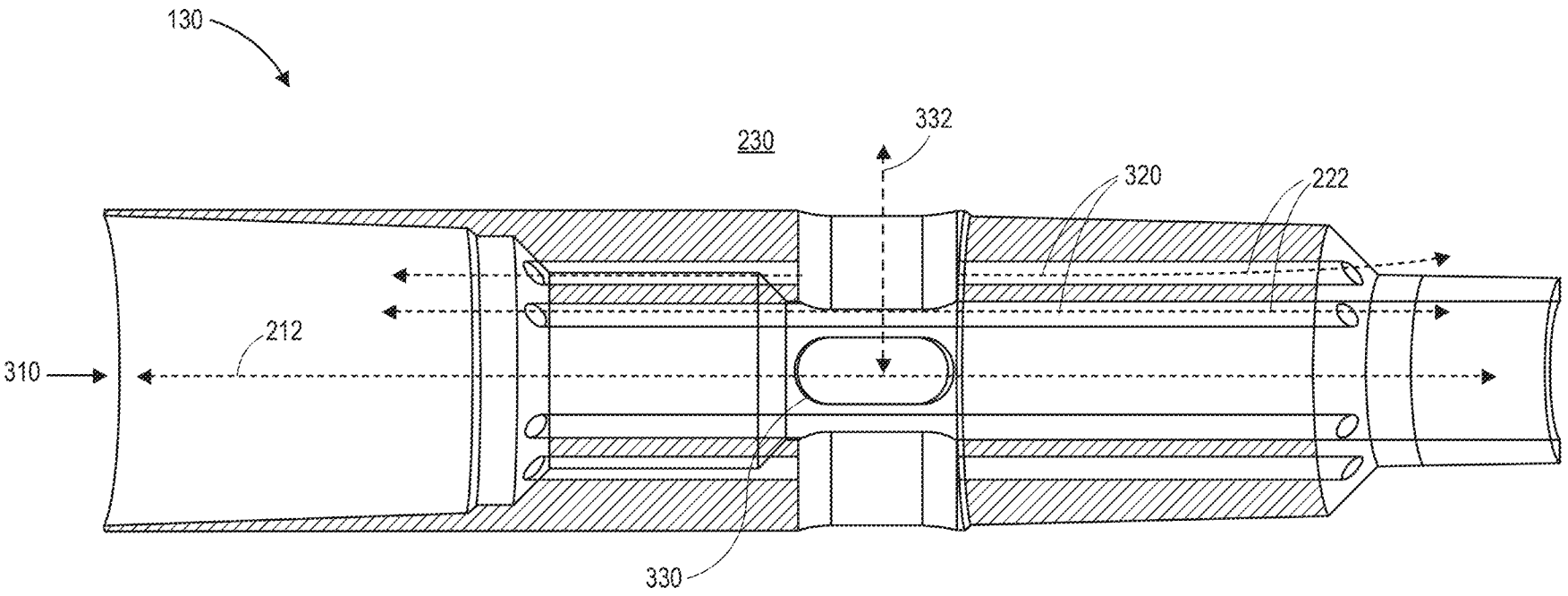
Figure 3C:
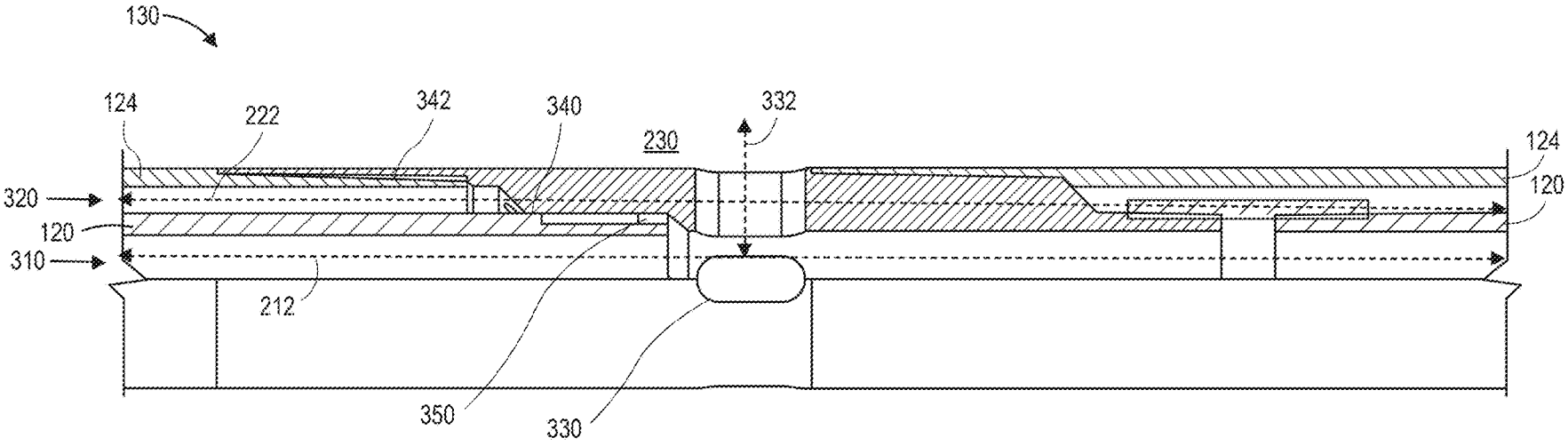

FIGS. 3A-3C illustrate a perspective view (FIG. 3A), a transparent side view (FIG. 3B), and a partial cross-sectional side view (FIG. 3C) of the production sub 130, according to an embodiment. Like the triple-connect device 110, the production sub 130 may also include one or more first axial bores 310 that define a portion of the first flowpath 212, and one or more second axial bores 320 that define a portion of the second flowpath 222.

The production sub 130 may also include one or more radial slots 330. The radial slots 330 may be axially-offset and/or circumferentially-offset from one another. In the embodiment shown, the radial slots 330 may provide radial flowpaths 332 between the first axial bores 210 and the annulus 230.

Referring to FIG. 3C, the dual string downhole tool 100 may also include a first (e.g., inner) work string 120 and/or a second (e.g., outer) work string 124. The inner and/or outer work strings 120, 124 may be coupled to and/or positioned between the triple-connect device 110 and the production sub 130. The inner work string 120 may include an axial bore that defines a portion of the first flowpath 212. An annulus may be defined (e.g., radially) between the work strings 120, 124, and the annulus may define a portion of the second flowpath(s) 222.

The production sub 130 may be connected to the inner work string 120 at a first connection location 340, and the production sub 130 may be connected to the outer work string 124 at a second connection location 342. The first and second connection locations 340, 342 may be axially-offset and/or radially-offset from one another.

The production sub 130 may also include one or more seals 350. The seal 350 may be positioned below the first and/or second connection locations 340, 342. The seal 350 may be or include a seal stack (e.g., V-packing). The seal 350 may be positioned (e.g., radially) between the inner work string 120 and the production sub 130. The seal 350 may prevent fluid flow between the first axial bores 310 (i.e., the first flowpath 212) and the second axial bores 320 (i.e., the second flowpath 222). The seal 350 may also or instead prevent fluid flow between the second axial bores 320 (i.e., the second flowpath 222) and the radial slots 330 (i.e., the radial flowpaths 332).

Referring again to FIG. 1, the dual string downhole tool 100 may also include one or more packers (two are shown: 140A, 140B). The packers 140A, 140B may be or include swell packers. The packers 140A, 140B may be positioned in the annulus 230 between the outer work string 124 and the surrounding tubular (not shown). The first packer 140A may be positioned between the triple-connect device 110 and the production sub 130. The second packer 140B may be positioned between the production sub 130 and a downstream sub, such as injection sub 150 (not shown in FIG. 1).

FIG. 4 illustrates a partial cross-sectional side view of the second portion of the dual string downhole tool 100 showing the injection sub 150 below the production sub 130, according to an embodiment. In an embodiment, a plurality of production subs 130 and injection subs 150 may be positioned in an alternating order (e.g., first production sub 130, first injection sub 150, second production sub, second injection sub, etc.).

As may be seen in FIG. 4, the second packer 140B may be positioned between the production sub 130 and the injection sub 150 to isolate a production zone 410 from an injection zone 420. The second packer 140B may also include one or more first axial bores 430 that define a portion of the first flowpath 212, and one or more second axial bores 440 that define a portion of the second flowpath 222. The other packers (e.g., packer 140A) in the dual string downhole tool 100 would also include one or more first axial bores 430 and one or more second axial bores 440.

The production zone 410 may be or include a portion of the annulus 230 and/or a portion of the reservoir that is in fluid communication with the production sub 130. For example, hydrocarbons from the reservoir may flow into this portion of the annulus 230 and into the production sub via the radial slots 330 (FIG. 3C). The injection zone 420 may be or include a portion of the annulus 230 and/or a portion of the reservoir that is in fluid communication with the injection sub 150. For example, water or gas (e.g., carbon dioxide or natural gas) may flow out of the injection sub 150 and into this portion of the annulus 230 and reservoir.

Figure 5:
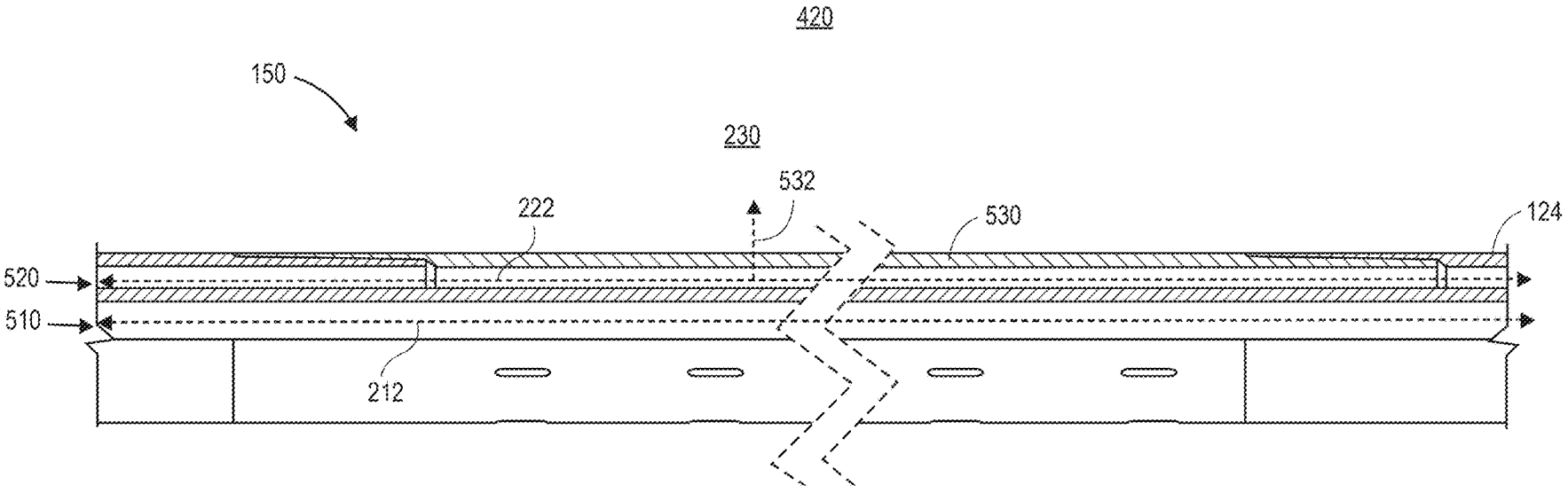
FIG. 5 illustrates an enlarged partial cross-sectional side view of the injection sub, according to an embodiment.

FIG. 5 illustrates an enlarged partial cross-sectional side view of the injection sub 150, according to an embodiment. Like the triple-connect device 110 and the production sub 130, the injection sub 150 may also include one or more first axial bores 510 that define a portion of the first flowpath 212, and one or more second axial bores 520 that define a portion of the second flowpaths 222. The injection sub 150 may also include a perforated pipe, a screen, and/or a mesh 530 that define one or more radial slots or openings. The length of the pipe/screen/mesh 530 and/or the diameter of the radial slots/openings may be varied to control the amount of fluid injected. In the embodiment shown, the radial slots may provide radials flowpaths 532 between the second axial bores 520 and the injection zone 420.

As described herein, the production sub 130 in the dual string downhole tool 100 may be used to receive hydrocarbons from the production zone(s) in the reservoir into the first flowpath 212. At the same time, the injection sub 150 in the dual string downhole tool 100 may be used to inject the second fluid through the second flowpath(s) 222 and into the injection zone(s) in the reservoir. In another embodiment, the functional roles of the production sub 130 and the injection sub 150 may be reversed. In other words, the production sub 130 in the dual string downhole tool 100 may be used to inject a fluid into an injection zone in the reservoir by pumping a fluid through the first flowpath 212 that exits out of the production sub 130. At the same time, the injection sub 150 in the dual string downhole tool 100 may be used to receive hydrocarbons from the production zone(s) in the reservoir that enter the injection sub 150 and move through the second flowpath(s) 222.

Figure 6:
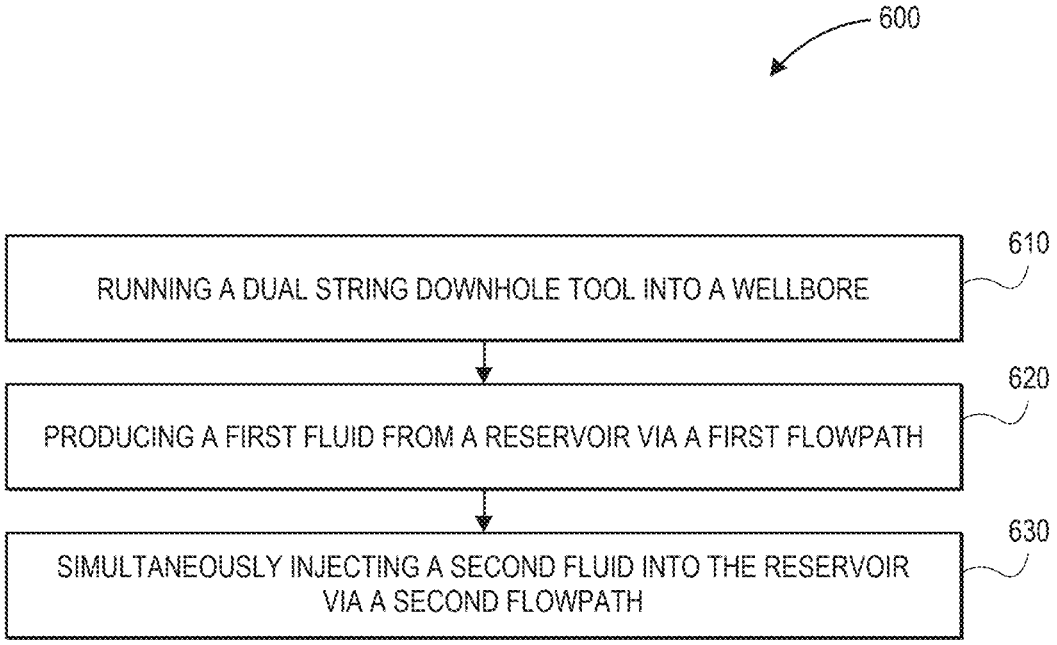
FIG. 6 illustrates a flowchart of a method for providing simultaneous injection and production within a single wellbore using the dual string downhole tool, according to an embodiment.

FIG. 6 illustrates a flowchart of a method 600 for providing simultaneous injection and production within a single wellbore using the dual string downhole tool 100, according to an embodiment. An illustrative order of the method 600 is provided below; however, one or more steps of the method 600 may be performed in a different order, simultaneously, repeated, or omitted.

The method 600 may include running the dual string downhole tool 100 into a wellbore, as at 610. The method 600 may also include producing a first fluid from a reservoir, as at 620. This may include receiving hydrocarbons from the production zone(s) 410 in the reservoir into the first flowpath 212. More particularly, the hydrocarbons may flow into the dual string downhole tool 100 via the radial slots 330 in the production sub 130. The hydrocarbons may then flow through the first axial bore 310 of the production sub 130, the bore in the inner work string 120, the first axial bore 210 of the triple-connect device 110, and up to the surface.

The method 600 may also include injecting a second fluid into the reservoir, as at 630. This may include pumping water or a gas (e.g., carbon dioxide and/or natural gas) through the second flowpath(s) 222 and into the injection zone(s) 420 in the reservoir. More particularly, the water or gas may be pumped through the second axial bores 220 of the triple-connect device 110, the annulus between the work strings 120, 124, the second axial bores 320 of the production sub 130, the second axial bores 520 of the injection sub 150, and then outward through the radial slots/openings via radial flowpaths 532. In an embodiment, steps 620 and 630 may be performed simultaneously.

Single String Downhole Tool

Figure 7:
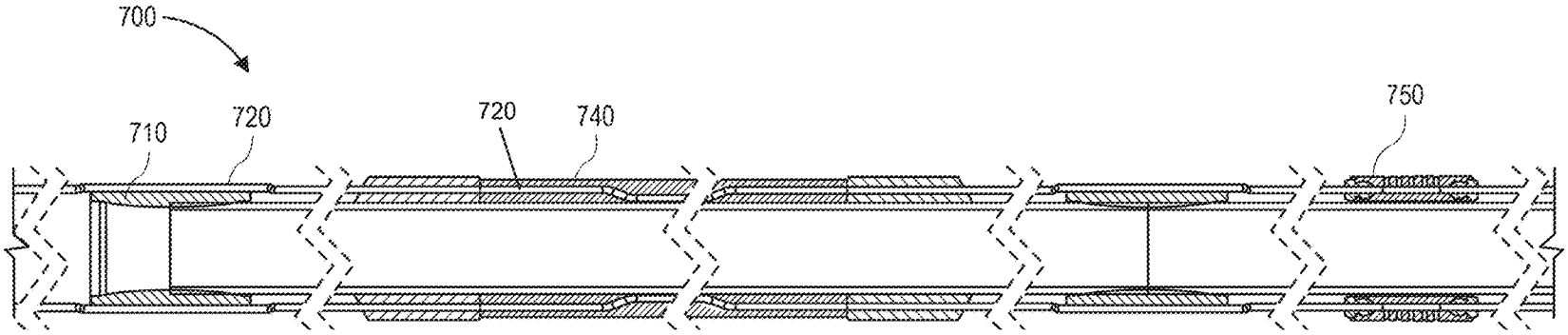
FIG. 7 illustrates a cross-sectional side view of a first portion of a single string downhole tool configured to provide simultaneous injection and production within the wellbore, according to an embodiment.
Figure 9:
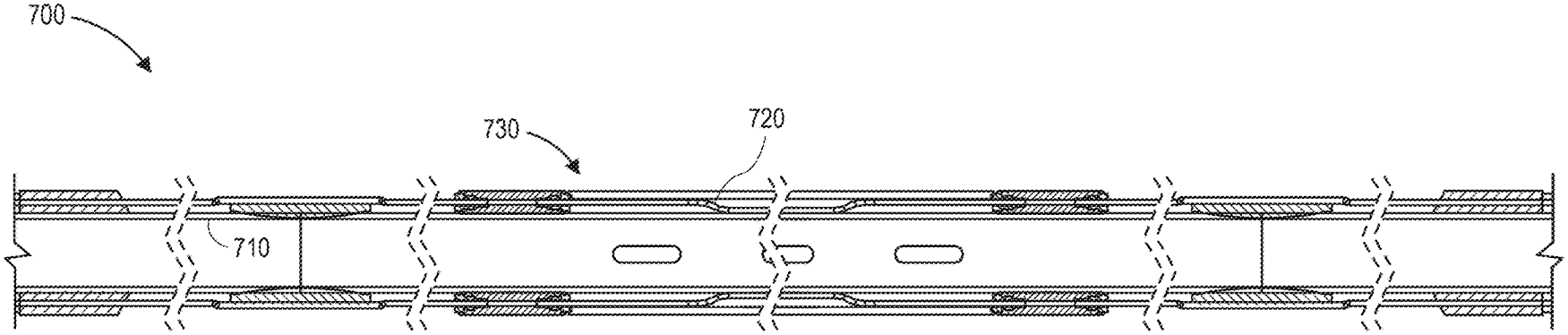
FIG. 9 illustrates a cross-sectional side view of a second portion of the single string downhole tool showing a production sub, according to an embodiment.

FIG. 7 illustrates a side view of a first portion of a single string downhole tool 700 showing an injection sub 750 (or an injection section), according to an embodiment. FIG. 9 illustrates a cross-sectional side view of a second portion of the single string downhole tool 100 showing a production sub 730 (or a production section), according to an embodiment. The single string downhole tool 700 shown in FIG. 7 and FIG. 9 is configured to provide simultaneous injection and production within the wellbore.

As shown in FIG. 7, the single string downhole tool 700 may include a work string 710. The single string downhole tool 700 may also include one or more (e.g., flexible) control lines 720. The control lines 720 may be positioned radially-outward from (e.g., wrapped at least partially around) the work string 710.

The single string downhole tool 700 may also include one or more packers (one is shown: 740). The packer 740 (or packer section) may be or include a swell packer. The packer 740 may be positioned (e.g., radially) around the work string 710 and/or the control line(s) 720. For example, the control line(s) 720 may be positioned radially-between the work string 710 and the packer 740.

The single string downhole tool 700 may also include one or more injection subs (one is shown: 750). The injection sub(s) 750 may slide over the work string 710 and be secured in place (e.g., with set screws). In another embodiment, each injection sub 750 may be coupled to and positioned between two segments of the work string 710.

Figure 8A:
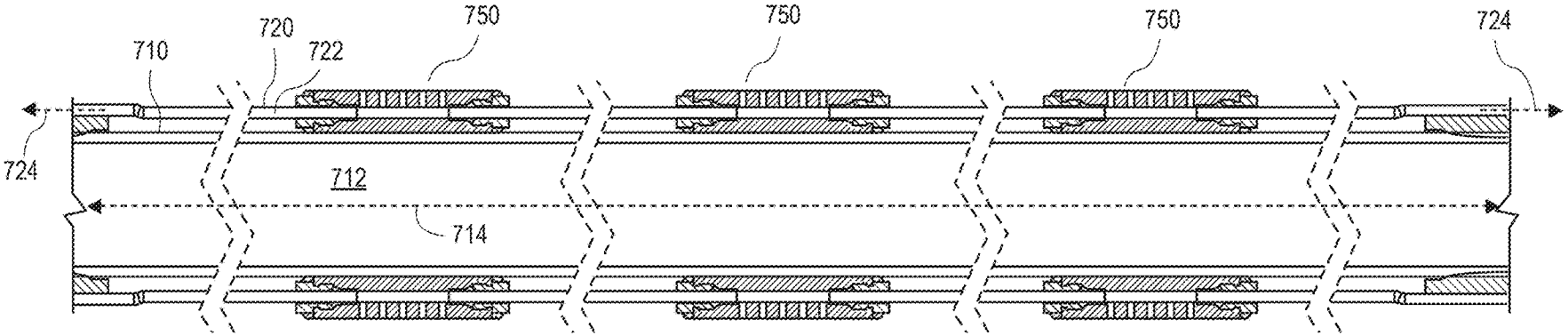
FIG. 8A illustrates a cross-sectional side view of a portion of the single string downhole tool showing a plurality of injection subs, according to an embodiment.

FIG. 8A illustrates an enlarged cross-sectional side view of a portion of the single string downhole tool 700, according to an embodiment. The work string 710 includes an axial bore 712 that defines a portion of a first flowpath 714 in the single string downhole tool 700. The control lines 720 include one or more second axial bores 722 that define one or more second flowpaths 724 in the single string downhole tool 700. In one embodiment, the first flowpath 714 may be used for production, and the second flowpath(s) 724 may simultaneously be used for injection. For example, the first flowpath 714 may allow a first fluid (e.g., hydrocarbons) to flow from one or more production zones 410 in the reservoir, into the single string downhole tool 700, and up to the surface. The second flowpath(s) 724 may simultaneously allow a second fluid (e.g., water or gas) to flow from the surface, through the single string downhole tool 700, and into one or more injection zones 420 in the reservoir.

Figure 8B:
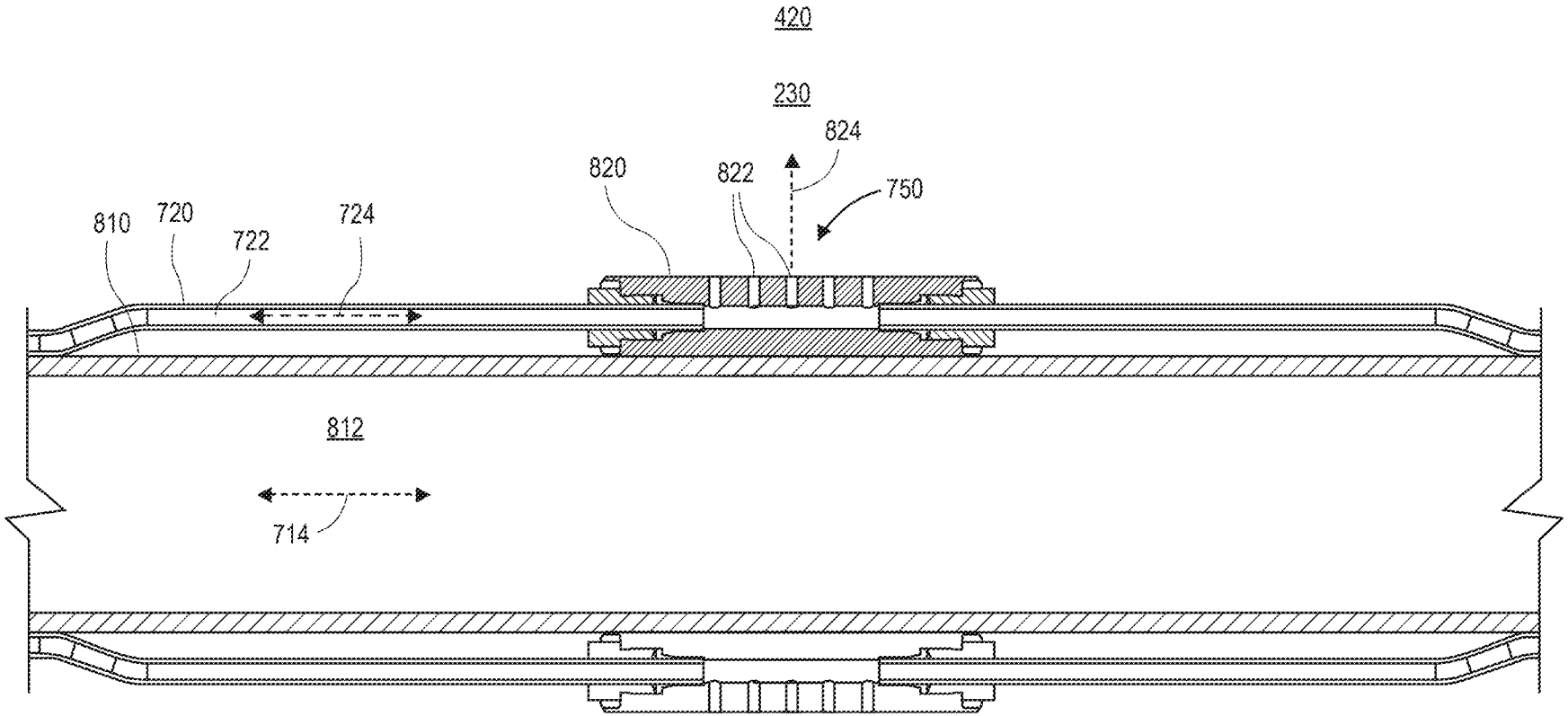
FIG. 8B illustrates an enlarged view of one of the injection subs, according to an embodiment.

FIG. 8B illustrates an enlarged view of one of the injection subs 750, according to an embodiment. The injection sub 750 may include an injection joint 810 that includes an axial bore 812 that define a portion of the first flowpath 714. The injection sub 750 may include a perforated pipe, a screen, and/or a mesh 820 that is positioned radially-outward from the injection joint 810. The pipe/screen/mesh 820 may define one or more radial slots 822. The radial slots 822 may be in fluid communication with the second axial bores 722 of the control lines 720. The length of the pipe/screen/mesh 820 and/or the diameter of the radial slots 822 may be varied to control the amount of fluid injected. In the embodiment shown, the radial slots 822 may provide radial flowpaths 824 between the second axial bore(s) 722 and the annulus 230 and/or injection zone 420.

FIG. 9 illustrates a cross-sectional side view of a second portion of the single string downhole tool 700 showing the production sub 730, according to an embodiment. The production sub(s) 730 may slide over the work string 710 and be secured in place (e.g., with set screws). In another embodiment, the production sub 730 may be coupled to and positioned between two segments of the work string 710. In an embodiment, a plurality of production subs 730 and injection subs 750 may be arranged in an alternating order (e.g., first production sub 730, first injection sub 750, second production sub, second injection sub, etc.).

Figure 10:
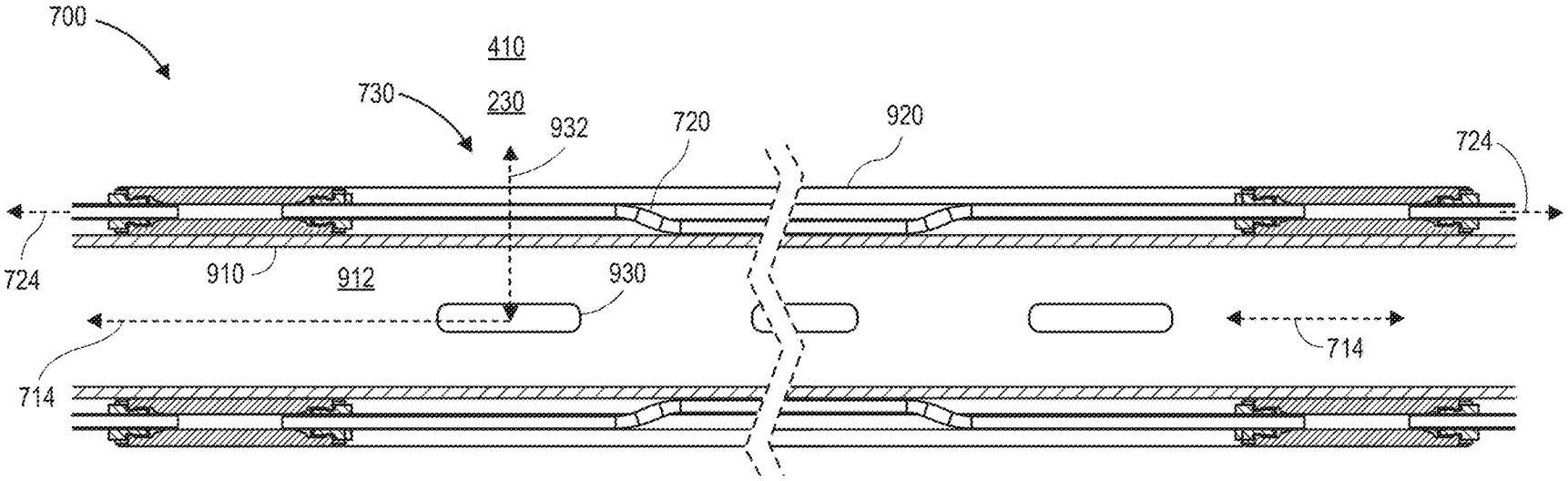
FIG. 10 illustrates an enlarged view of the production sub, according to an embodiment.

FIG. 10 illustrates an enlarged view of the production sub 730, according to an embodiment. The production sub 730 may include a production joint 910 and a production screen 920. The production screen 920 may be positioned radially-outward from the production joint 910. The production joint 910 may include an axial bore 912 that defines a portion of the first flowpath 714. The control line(s) 720, which define the second flowpath(s) 724, may run/extend between the production joint 910 and the production screen 920.

The production joint 910 may also include one or more radial slots 930. In the embodiment shown, the radial slots 930 may provide radial flowpaths 932 between the first flowpath 714 in the first axial bore 912 and the annulus 230 and/or production zone 410. Thus, in this embodiment, the first fluid (e.g., hydrocarbons) may flow from the production zone 410, through the radial slots 930, and into the first axial bore 912.

As described herein, the production sub 730 in the single string downhole tool 700 may be used to receive hydrocarbons from the production zone(s) in the reservoir into the first flowpath 714. At the same time, the injection sub 750 in the single string downhole tool 700 may be used to inject the second fluid through the second flowpath(s) 724 and into the injection zone(s) in the reservoir. In another embodiment, the functional roles of the production sub 730 and the injection sub 750 may be reversed. In other words, the production sub 730 in the single string downhole tool 700 may be used to inject a fluid into an injection zone in the reservoir by pumping a fluid through the first flowpath 714 that exits out of the production sub 730. At the same time, the injection sub 750 in the single string downhole tool 700 may be used to receive hydrocarbons from the production zone(s) in the reservoir that enter the injection sub 750 and move through the second flowpath(s) 724.

Figure 11:
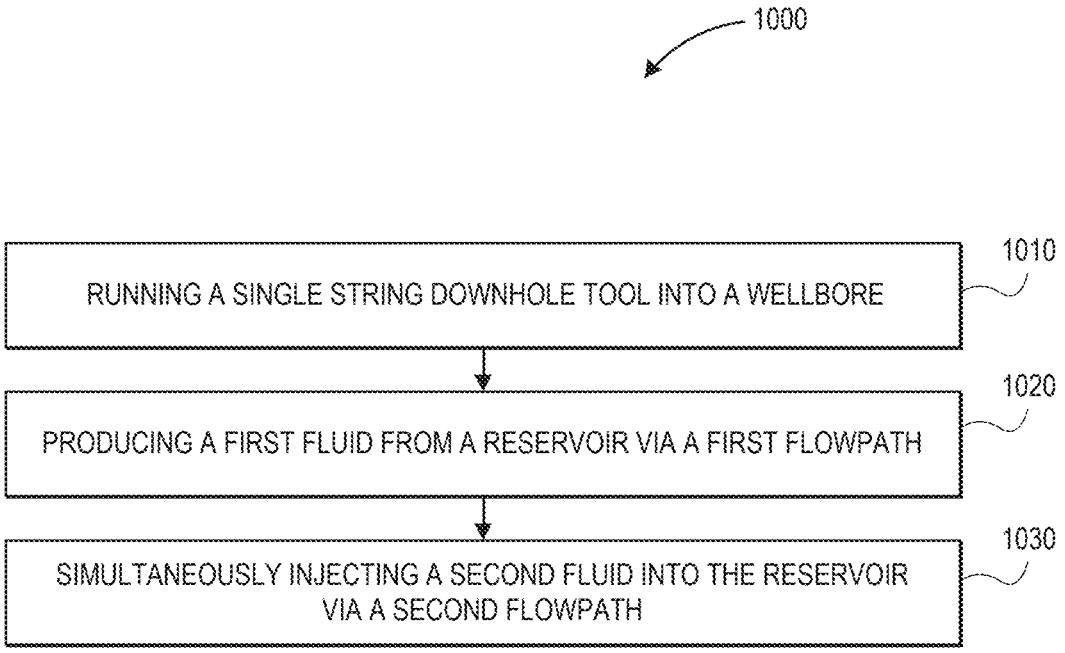
FIG. 11 illustrates a flowchart of a method for providing simultaneous injection and production within a single wellbore using the single string downhole tool, according to an embodiment.

FIG. 11 illustrates a flowchart of a method for providing simultaneous injection and production within a single wellbore using the single string downhole tool 700, according to an embodiment. An illustrative order of the method 1000 is provided below; however, one or more steps of the method 1000 may be performed in a different order, simultaneously, repeated, or omitted.

The method 1000 may include running the single string downhole tool 700 into a wellbore, as at 1010. The method 700 may also include producing a first fluid from a reservoir, as at 1020. This may include receiving hydrocarbons from the production zone(s) 410 in the reservoir into the first flowpath 714. More particularly, the hydrocarbons may flow into the single string downhole tool 700 via the radial slots 930 in the production sub 730. The hydrocarbons may then flow through the axial bore 912 of the production sub 730, the bore in the work string 710, and up to the surface.

The method 1000 may also include injecting a second fluid into the reservoir, as at 1030. This may include pumping water or a gas (e.g., carbon dioxide and/or natural gas) through the second flowpath(s) 724 and into the injection zone(s) 420 in the reservoir. More particularly, the water or gas may be pumped from the surface, through the control line(s) 720, and out the radial slots 822 in the injection sub(s) 750. In an embodiment, steps 1020 and 1030 may be performed simultaneously.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool for use in a wellbore, the downhole tool comprising:

a body defining (1) a first flowpath configured to allow a first fluid from a production zone in the wellbore to flow in a first direction through the body and (2) a plurality of second flowpaths configured to allow a second fluid to flow in a second, opposing direction and be injected into an injection zone in the wellbore simultaneously with the first fluid flowing through the first flowpath, wherein the body comprises:

a triple-connect device configured to be connected to a work string, wherein the first flowpath is positioned radially-inward from the second flowpaths in the triple-connect device, wherein the first flowpath is not in fluid communication with the second flowpaths in the triple-connect device, and wherein the second flowpaths are circumferentially-offset from one another around the first flowpath in the triple-connect device;

a production sub positioned downstream from the triple-connect device, wherein the production sub has one or more radial slots in communication with the first flowpath to allow the first fluid to flow from the production zone in the wellbore into the first flowpath in the production sub, wherein the one or more radial slots in the production sub are perpendicular to and extend between the second flowpaths in the production sub, and wherein the one or more radial slots are not in fluid communication with the second flowpaths in the production sub; and an injection sub positioned downstream from the triple-connect device and upstream or downstream from the production sub, wherein the injection sub includes a perforated pipe, a screen, or a mesh positioned around the second flowpaths, and wherein the injection sub has one or more radial slots in communication with the second flowpaths to allow the second fluid to be injected from the second flowpaths into the injection zone in the wellbore.

2. The downhole tool of claim 1, wherein the body includes a packer section that is configured to isolate the production zone from the injection zone.

3. The downhole tool of claim 1, wherein the second flowpath includes a control line disposed on an outside surface of the body.

4. The downhole tool of claim 1, wherein the first and second flowpaths are switchable, which results in the second fluid flowing through the first flowpath and the first fluid flowing through the second flowpath.

5. A method of using a downhole tool in a wellbore, the method comprising:

running the downhole tool into the wellbore, wherein the downhole tool comprises a body defining a first fluid flowpath and a plurality of second fluid flowpaths;

producing a first fluid from a production zone in the wellbore via the first flowpath, wherein the first fluid flows in a first direction; and injecting a second fluid into an injection zone of the wellbore via the second flowpath simultaneously with producing the first fluid via the first flowpath, wherein the second fluid flows in a second, opposing direction;

wherein the body comprises:

a triple-connect device configured to be connected to a work string, wherein the first flowpath is positioned radially-inward from the second flowpaths in the triple-connect device, wherein the first flowpath is not in fluid communication with the second flowpaths in the triple-connect device, and wherein the second flowpaths are circumferentially-offset from one another around the first flowpath in the triple-connect device;

a production sub positioned downstream from the triple-connect device, wherein the production sub has one or more radial slots in communication with the first flowpath to allow the first fluid to flow from the production zone in the wellbore into the first flowpath in the production sub, wherein the one or more radial slots in the production sub are perpendicular to and extend between the second flowpaths in the production sub, and wherein the one or more radial slots are not in fluid communication with the second flowpaths in the production sub; and an injection sub positioned downstream from the triple-connect device and upstream or downstream from the production sub, wherein the injection sub includes a perforated pipe, a screen, or a mesh positioned around the second flowpaths, and wherein the injection sub has one or more radial slots in communication with the second flowpaths to allow the second fluid to be injected from the second flowpaths into the injection zone in the wellbore.

6. The method of claim 5, further comprising isolating the production zone from the injection zone.

7. A downhole tool for use in a wellbore, the downhole tool comprising:

a triple-connect device having a first flowpath and a plurality of second flowpaths, wherein the first flowpath is positioned radially-inward from the second flowpaths, wherein the first flowpath is not in fluid communication with the second flowpaths, and wherein the second flowpaths are circumferentially-offset from one another around the first flowpath;

a production sub connected to the triple-connect device, the first flowpath and the second flowpaths extending through the production sub, the production sub having one or more radial slots in communication with the first flowpath to allow a first fluid to flow from a production zone in the wellbore into the first flowpath, wherein the one or more radial slots in the production sub are perpendicular to and extend between the second flowpaths, and wherein the one or more radial slots are not in fluid communication with the second flowpaths;

an injection sub connected to the triple-connect device, the first flowpath and the second flowpaths extending through the injection sub, the injection sub including a perforated pipe, a screen, or a mesh positioned around the second flowpaths, the injection sub having one or more radial slots in communication with the second flowpaths to allow a second fluid to be injected from the second flowpaths into an injection zone in the wellbore, and wherein the second fluid flows through the second flowpaths simultaneously with the first fluid flowing through the first flowpath;

a work string connected to and positioned between the triple-connect device and the production sub and/or between the production sub and the injection sub, wherein the work string comprises an inner portion and an outer portion that are concentric with one another, wherein the first flowpath extends through the inner portion, and wherein the second flowpath is defined between the inner and outer portions; and a packer positioned between the production sub and the injection sub, wherein the packer is positioned around the outer portion of the work string.

8. The downhole tool of claim 7, wherein the first fluid and the second fluid flow in opposite directions.

* * * * *